US010926149B2

(12) United States Patent
Scott et al.

(10) Patent No.: US 10,926,149 B2
(45) Date of Patent: Feb. 23, 2021

(54) FIXED FLEXIBLE MULTI-USE STRIKING TRAINING DEVICE

(71) Applicant: Tyler Scott, New York, NY (US)

(72) Inventors: Tyler Scott, New York, NY (US); Kurt Hafeken, Sr., Edmond, OK (US)

(73) Assignee: Tyler Scott, New York, NY (US)

( * ) Notice: Subject to any disclaimer, the term of this patent is extended or adjusted under 35 U.S.C. 154(b) by 0 days.

(21) Appl. No.: 16/129,135

(22) Filed: Sep. 12, 2018

(65) Prior Publication Data

US 2020/0078652 A1 Mar. 12, 2020

(51) Int. Cl.
*A63B 69/20* (2006.01)
*A63B 69/24* (2006.01)

(52) U.S. Cl.
CPC ..... *A63B 69/201* (2013.01); *A63B 69/24* (2013.01)

(58) Field of Classification Search
CPC ..... A63B 69/20–325
See application file for complete search history.

(56) References Cited

U.S. PATENT DOCUMENTS

| | | | | |
|---|---|---|---|---|
| 341,231 | A | 5/1886 | Goodman | |
| 410,475 | A | 9/1886 | Widger | |
| 952,862 | A | 3/1910 | Armstrong | |
| 2,037,508 | A | 4/1936 | Gilman | |
| 2,197,545 | A | 4/1940 | Backman et al. | |
| 4,491,315 | A * | 1/1985 | Dye | A63B 69/201 473/442 |
| 4,527,796 | A | 7/1985 | Critelli | |
| 4,770,412 | A | 9/1988 | Wolfe | |
| 5,389,057 | A * | 2/1995 | Zagata, Jr. | A63B 69/004 482/83 |
| 5,941,801 | A | 8/1999 | D'Alto | |
| 6,027,435 | A | 2/2000 | Nadorf et al. | |
| 6,106,443 | A | 8/2000 | Kuo | |
| 6,390,958 | B1 | 5/2002 | Chu | |
| 6,398,697 | B1 * | 6/2002 | Nichols, Jr. | A63B 69/20 473/441 |
| 6,790,167 | B1 | 9/2004 | Carlin et al. | |
| 6,994,658 | B2 | 2/2006 | Laudenslager et al. | |
| 7,063,648 | B1 | 6/2006 | Brigham | |
| 7,226,398 | B2 | 6/2007 | Fu | |
| 7,297,092 | B1 | 11/2007 | Gaynor | |
| 7,357,760 | B1 * | 4/2008 | Rios | A63B 69/004 473/444 |

(Continued)

FOREIGN PATENT DOCUMENTS

| | | |
|---|---|---|
| GB | 2463537 | 3/2010 |
| KR | 1020050029154 | 3/2005 |

OTHER PUBLICATIONS

KIPO, "International Search Report", dated Jan. 2, 2020, Published in: WO.

*Primary Examiner* — Jennifer Robertson
*Assistant Examiner* — Catrina A Letterman
(74) *Attorney, Agent, or Firm* — Head, Johnson, Kachigian & Wilkinson, PC

(57) ABSTRACT

A training device comprising a flexible rod capable of being mounted at an upper end to an upper structure, such as a ceiling, and at a lower end to a lower structure, such as a floor, and a punching bag mounted to the flexible rod. The flexible rod may be capable of deformation followed by a quick return to an original position when the punching bag is struck.

11 Claims, 6 Drawing Sheets

(56) References Cited

U.S. PATENT DOCUMENTS

| | | | | |
|---|---|---|---|---|
| 7,704,194 | B1 * | 4/2010 | Chen | A63B 69/208 482/83 |
| 7,927,260 | B1 * | 4/2011 | Stalka | A63B 69/206 482/83 |
| 7,981,009 | B2 | 7/2011 | Brenner et al. | |
| 8,052,582 | B2 | 11/2011 | Summers | |
| 8,376,916 | B2 | 2/2013 | Tsakiris | |
| D697,157 | S | 1/2014 | Siklosi et al. | |
| D706,886 | S | 6/2014 | Hafeken, Sr. et al. | |
| D706,887 | S | 6/2014 | Siklosi et al. | |
| 8,814,729 | B2 | 8/2014 | Hartigan | |
| 9,174,108 | B2 | 11/2015 | Siklosi et al. | |
| 9,414,649 | B1 | 8/2016 | Siklosi | |
| 10,065,098 | B2 * | 9/2018 | Almeras | A63B 69/20 |
| 2003/0073548 | A1 | 4/2003 | Haselrig | |
| 2003/0125168 | A1 * | 7/2003 | Hackaday | A63B 69/206 482/89 |
| 2004/0209743 | A1 | 10/2004 | Perez | |
| 2006/0019803 | A1 | 1/2006 | Giaquinta et al. | |
| 2007/0117689 | A1 | 5/2007 | MacKay et al. | |
| 2008/0254950 | A1 | 10/2008 | Bellies | |
| 2009/0088302 | A1 | 4/2009 | Brenner et al. | |
| 2009/0318272 | A1 * | 12/2009 | Evans | A63B 69/004 482/86 |
| 2011/0077134 | A1 | 3/2011 | Smith | |
| 2011/0111928 | A1 * | 5/2011 | Tsakiris | A63B 69/201 482/87 |
| 2011/0237404 | A1 * | 9/2011 | Smith | A63B 69/201 482/83 |
| 2012/0252637 | A1 * | 10/2012 | Pellot | A63B 69/206 482/89 |
| 2013/0017931 | A1 | 1/2013 | Mechling et al. | |
| 2013/0065735 | A1 * | 3/2013 | Conarty | A63B 69/20 482/89 |
| 2013/0331235 | A1 | 12/2013 | Fields et al. | |
| 2014/0066268 | A1 | 3/2014 | Hafeken et al. | |
| 2014/0221172 | A1 | 8/2014 | Siklosi et al. | |
| 2015/0352424 | A1 | 12/2015 | Ruggiero et al. | |
| 2016/0059100 | A1 | 3/2016 | Chen | |
| 2018/0221745 | A1 * | 8/2018 | Lamark | A63B 69/208 |

* cited by examiner

FIXED FLEXIBLE MULTI-USE STRIKING TRAINING DEVICE

CROSS REFERENCE

Not Applicable.

BACKGROUND OF THE INVENTION

Field of the Invention

This invention relates generally to a fixed flexible multi-use striking training device, and more particularly, but not by way of limitation, to a punching bag that has a flexible support running vertically therethrough that is mounted at the floor and ceiling.

Description of the Related Art

The hanging heavy punching bag, which typically hangs from the ceiling, a ceiling joist, or other elevated structure, is one of the earliest forms of punching bag training devices. Hanging heavy bags offer many advantages but suffer from a major disadvantage: they swing when struck.

Based on the foregoing, it is desirable to provide a mounted punching bag that has some give, but snaps back into place so that the user does not have to contend with the swinging and momentum of a hanging bag.

SUMMARY OF THE INVENTION

In general, in a first aspect, the invention relates to a training device comprising an elongate structure capable of being mounted at an upper end to an upper structure and at a lower end to a lower structure and a punching bag mounted to the elongate structure. The elongate structure may be flexible such that it is capable of deformation followed by a quick return to an original position when the punching bag is struck.

The elongate structure may be a flexible rod. The upper structure may be a ceiling, and the lower structure may be a floor. The training device may further comprise an upper mount connected to the upper end of the elongate structure and a lower mount connected to the lower end of the lower structure.

The punching bag may be height adjustable. In other words, the punching bag may be removably mounted to the elongate structure such that the punching bag may be repositioned vertically along the elongate structure.

The training device may further comprise a stem, where the punching bag mounts to the elongate structure via the stem. The stem may be receivable in an inner cylinder of the punching bag and the elongate structure may be receivable in an inner tube in the stem. The punching bag, the stem, and the elongate structure may be coaxial. The inner cylinder of the punching bag may have a diameter greater than a diameter of the stem, such that the punching bag is capable of freely moving vertically along the stem. The punching bag and the stem may each comprise a cover filled with padding.

The training device may further comprise a collar, where the collar is removably mountable to the stem and where the collar has a diameter greater than a diameter of the inner cylinder of the punching bag such that the punching bag is capable of resting atop the collar and the collar is capable of preventing the punching bag from falling below a desired height. The collar may be repositionable on the stem. In particular, the collar may attach to the stem via hook and loop material. The collar may comprise a cover filled with padding.

Figure 1:
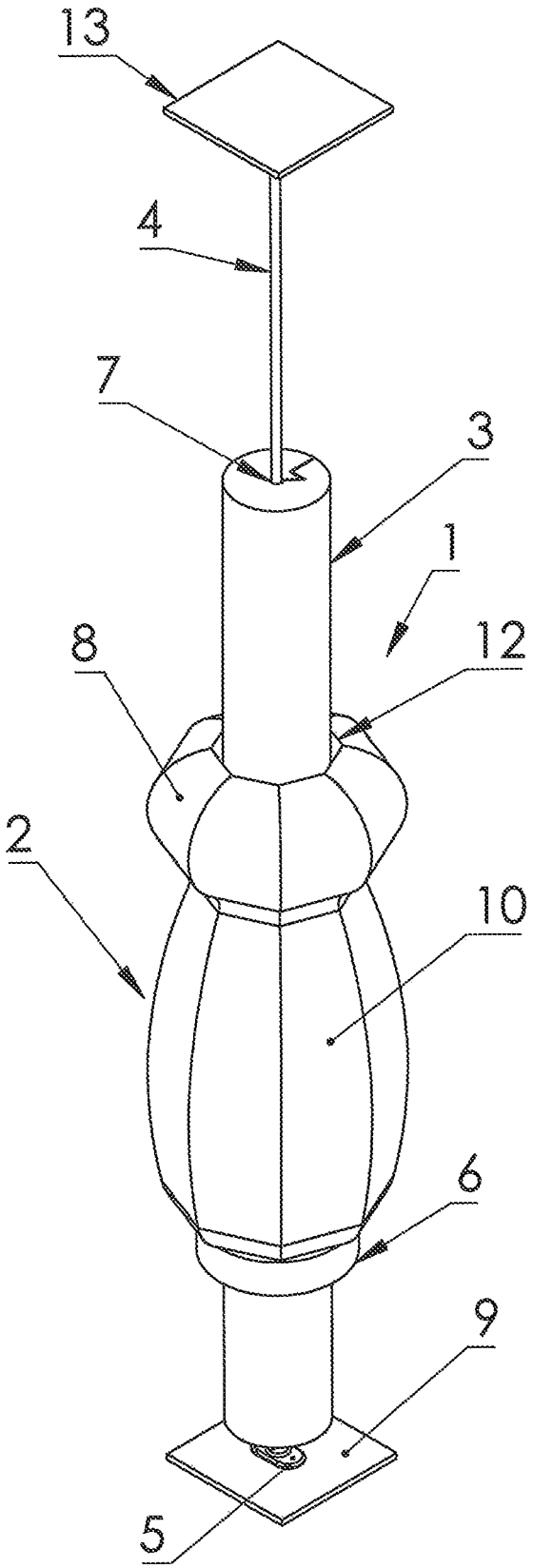
FIG. 1 is a perspective view of the fixed flexible multi-use striking training device.
Figure 2:
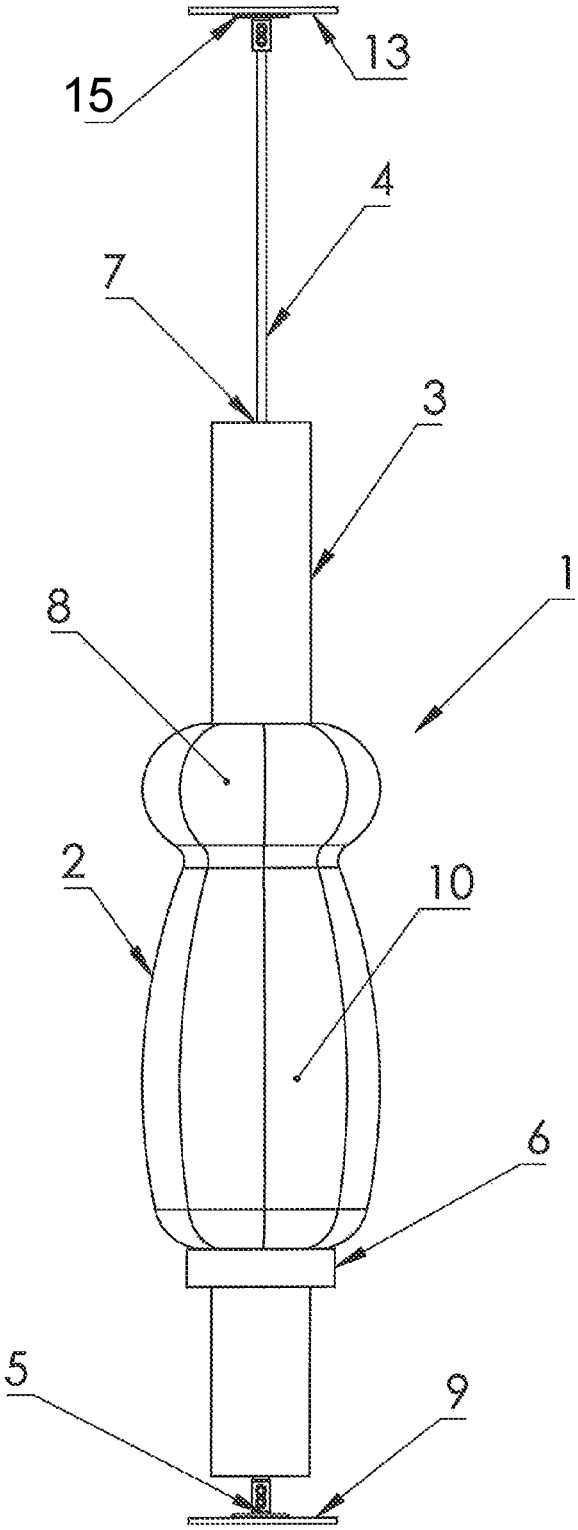
FIG. 2 is a front view of the fixed flexible multi-use striking training device.
Figure 3:
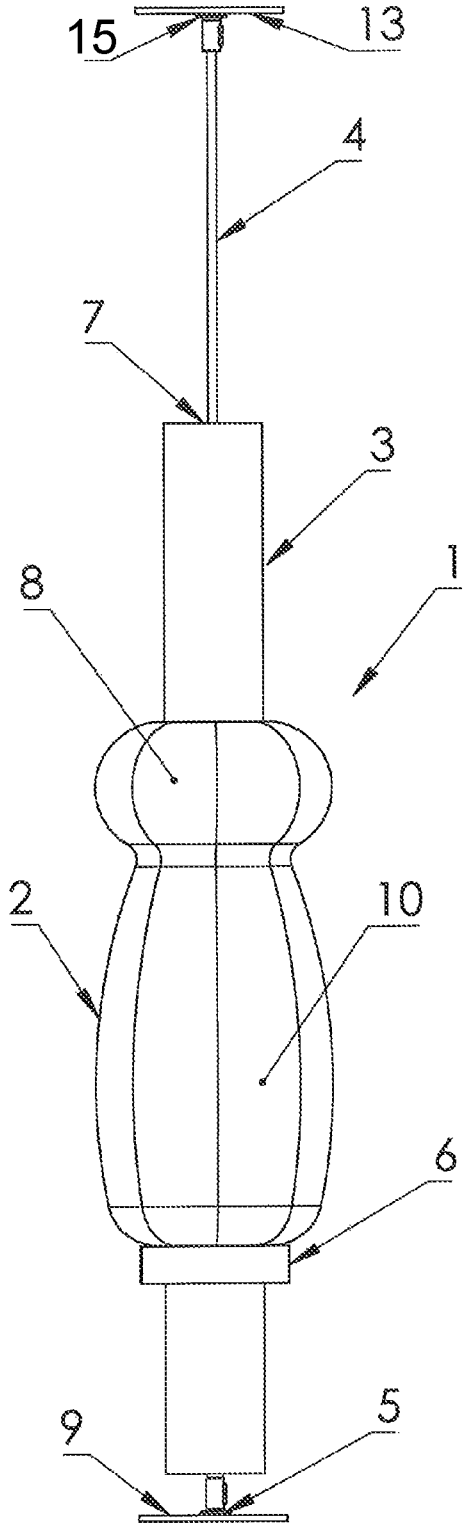
FIG. 3 is a back view of the fixed flexible multi-use striking training device.
Figure 4:
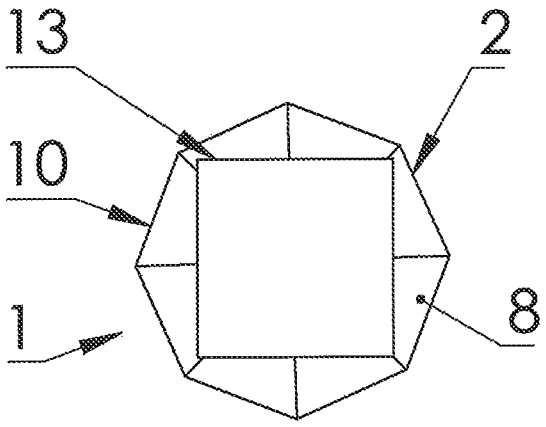
FIG. 4 is a top view of the fixed flexible multi-use striking training device.
Figure 5:
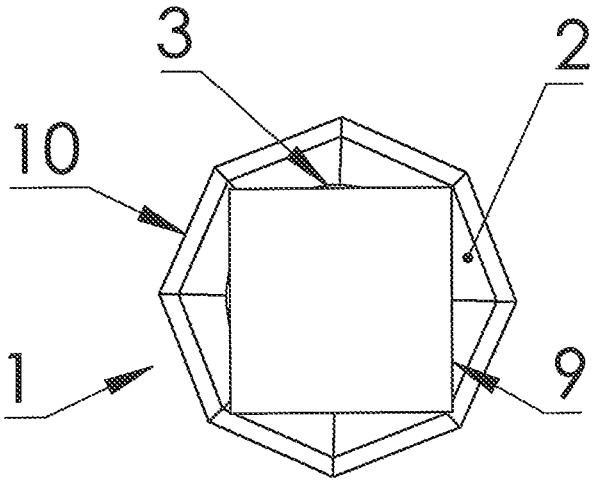
FIG. 5 is a bottom view of the fixed flexible multi-use striking training device.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

In general, in a first aspect, the invention relates to exercising devices, and has among its objects and advantages the provision of an improved punching bag.

The object of the invention is to provide a punching bag characterized by a quick recovery after being struck. The bag may be shaped to simulate the head and body of an opponent, as shown in the drawings. Alternately, the bag could be a cylinder shape, a torso shape, a ball shape, or any other shape that is appropriate for striking bags. The bag may embody a structure operating to minimize the force of recoil and as such may lend itself to rehabilitation of injuries such as shoulder, elbow, or wrist injuries.

As shown in FIG. 1, a bag 1 may include a head part 8 and a body part 2. Alternately, the bag 1 may be a cylinder shape, a torso shape, a ball shape, or any other desired shape. The bag 1 may be mounted upon a flexible rod structure 4, which may be fixedly connected at its lower end with a first mount 5 anchored to the floor 9 or other lower surface and at its upper end with a second mount 15 anchored to the ceiling 13 or other upper surface. The flexible rod 4 may yield when the bag 1 is struck to permit oscillation of the bag 1, but may operate to impart a quick return movement to the bag 1.

The bag 1 may comprise a cover 10, which may be made of leather, synthetic material, or any other desired material, and may be filled with padding 11, such as foam or other suitable resilient material. The bag 1 may have an inner cylinder 12 extending vertically therethrough, from the top of the head part 8 to the bottom of the body part 2, or other wise from the top to the bottom of the bag 1 if the bag 1 does not have a head part 8 and a body part 2. The inner cylinder 12 may be hollow with an open top and an open bottom, providing an open column running vertically through the bag 1.

A stem 3 may be mounted on the flexible rod 4, with the stem 3 located between the bag 1 and the rod 4. The stem 3 may extend vertically through the inner cylinder 12, as well as extending above and below the bag 1 along the rod 4, as shown. The inner cylinder 12 and the stem 3 may be sized such that the bag 1 may freely slide upward and downward on the stem 3 and/or may freely spin on the stem 3; alternately, the inner cylinder 12 and the stem 3 may be sized such that the bag 1 may not freely slide or spin on the stem 3. For example, the outer diameter of the stem 3 may be greater than the inner diameter of the inner cylinder 12, requiring compression of the stem 3 for placement within the inner cylinder 12 and allowing the bag 1 to resist movement on the stem 3.

The stem 3 may likewise comprise a cover 10, which may be made of leather, synthetic material, or any other desired material, and may be filled with padding 11, such as foam or other suitable resilient material. A tube 7 may extend vertically through the center of the stem 3. The rod 4 may extend vertically through the tube 7, as well as extending above and below the stem 3 to the floor and ceiling mounts 5 and 15, as shown. The tube 7 may be semi-rigid, and the bendable nature of the tube 7 may permit bending of the stem 3 and bag 1. The tube 7 and the rod 4 may be sized such that the stem 3 may freely slide upward and downward on the rod 4 and/or may freely spin on the rod 4; alternately, the tube 7 and the rod 4 may be sized such that the stem 3 may not freely slide or spin on the rod 4.

When the device is struck, the bag 1 may move away from the strike. The semi-rigid tube 7 and the rod 4 may perform an important function in breaking the force of the recoiling bag 1. When the bag 1 is struck during a rapid recovery movement, the bending action may bend to break the force of the impact, which might otherwise injure the user.

Normally, the flexible rod structure 4 may support the bag 1 in the vertical position, as shown in FIG. 1. The flexible rod structure 4 may impart a rapid rebound of the bag so as to position the bag in a vertical position by the time the user is ready for another blow.

A collar 6 may be used to adjust the height of the bag 1 on the stem 3. The collar 6 may wrap around and attach to the stem 3 in a tight manner and may be fastened securely. The collar 6 may likewise comprise a cover 10, which may be made of leather, synthetic material, or any other desired material, and may be filled with padding 11, such as foam or other suitable resilient material. Thus, if the collar 6 is struck, it may not cause injury to the user. The collar 6 may have a toroid shape, or any other desired shape.

Figure 6:
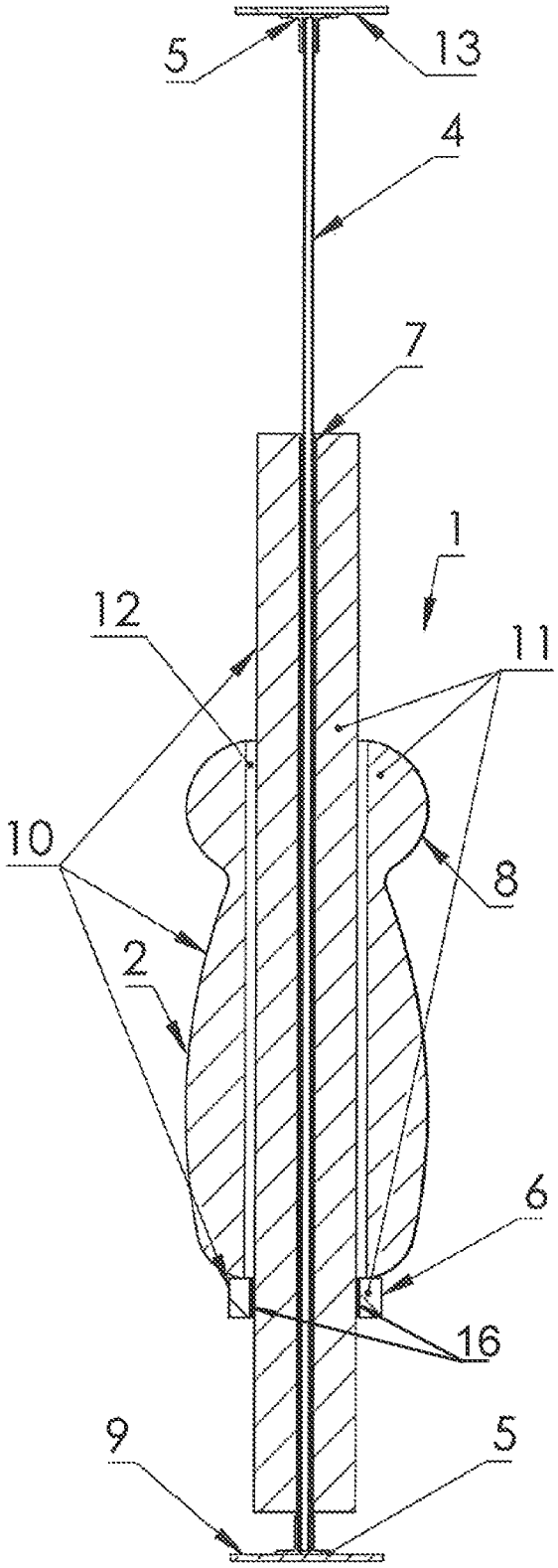
FIG. 6 is a cutaway front view of the fixed flexible multi-use striking training device.

The collar 6 may be repositionable to place the bag 1 at a desired height on the stem 3. For example, the stem 3 may have one or more strips of loop material around its outer surface, and the collar 6 may have hook material on its inner surface. Thus, the collar 6 may be secured to the stem 3 by wrapping the collar 6 around the stem 3 at the location of the loop material, securing the hook material of the collar 6 to the loop material of the stem 3. Therefore, the collar 6 may attach to the stem 3 via hook and loop material 16 as shown in FIG. 6. Alternately, any other desired connection device or method may be used to secure the collar 6 to the stem 3.

The bag 1, stem 3, and collar 6 may be padded to a degree of firmness simulating the body of an adversary. The bag 1, stem 3, collar 6, or any combination thereof may not have any other structures within the cover 10 other than the padding 11. In other words, the bag 1, stem 3, collar 6, or any combination thereof may not have any hard or rigid structures therein, with the exception of the semi-rigid tube 7 in the stem 3.

The bag 1, stem 3, and rod 4 may be coaxial, as may be the collar 6.

Whereas, the devices and methods have been described in relation to the drawings and claims, it should be understood that other and further modifications, apart from those shown or suggested herein, may be made within the spirit and scope of this invention.

What is claimed is:

1. A training device comprising:

an elongate structure capable of being mounted at an upper end to an upper structure and at a lower end to a lower structure;

a punching bag mounted to the elongate structure;

where the elongate structure is flexible such that it is capable of deformation followed by a quick return to an original position when the punching bag is struck;

a stem, where the punching bag mounts to the elongate structure via the stem and where the elongate structure is receivable in an inner tube in the stem;

an inner cylinder of the punching bag, where the stem is receivable in the inner cylinder of the punching bag and where the inner cylinder of the punching bag has a diameter greater than the stem, such that the punching bag is capable of freely moving vertically along the stem, where the punching bag, stem, and inner cylinder are configured for the punching bag to freely slide upward and downward on the stem such that, when struck, the punching bag moves away from the strike; and a collar, where the collar is removably mountable to the stem and where the collar has a diameter greater than a diameter of the inner cylinder of the punching bag such that the punching bag is capable of resting atop the collar on the stem and the collar is capable of preventing the punching bag from falling along the stem below a desired height on the stem.

2. The training device of claim 1 where the elongate structure is a flexible rod.

3. The training device of claim 1 where the upper structure is a ceiling.

4. The training device of claim 1 where the lower structure is a floor.

5. The training device of claim 1 further comprising an upper mount connected to the upper end of the elongate structure and a lower mount connected to the lower end of the elongate structure.

6. The training device of claim 1 where the punching bag is height adjustable, such that the punching bag is removably mounted to the elongate structure such that the punching bag may be repositioned vertically along the elongate structure.

7. The training device of claim 1 where the punching bag, the stem, and the elongate structure are coaxial.

8. The training device of claim 1 where the punching bag and the stem each comprise a cover filled with padding.

9. The training device of claim 1 where the collar is repositionable on the stem.

10. The training device of claim 1 where the collar attaches to the stem via hook and loop material.

11. The training device of claim 1 where the collar comprises a cover filled with padding.

* * * * *